US011623131B2

(12) United States Patent
Wennesland

(10) Patent No.: US 11,623,131 B2
(45) Date of Patent: Apr. 11, 2023

(54) SPORTS BALL REBOUND AND BOUNDARY SYSTEM

(71) Applicant: Parklife Innovations Ltd., London (GB)

(72) Inventor: Anders Wennesland, Marouai (GR)

(73) Assignee: PARKLIFE INNOVATIONS LTD., London (GB)

( * ) Notice: Subject to any disclaimer, the term of this patent is extended or adjusted under 35 U.S.C. 154(b) by 287 days.

(21) Appl. No.: 16/981,405

(22) PCT Filed: Mar. 18, 2019

(86) PCT No.: PCT/GB2019/000049

§ 371 (c)(1),
(2) Date: Sep. 16, 2020

(87) PCT Pub. No.: WO2019/180399

PCT Pub. Date: Sep. 26, 2019

(65) Prior Publication Data

US 2021/0008440 A1 Jan. 14, 2021

(30) Foreign Application Priority Data

Mar. 17, 2018 (GB) ..... 1804312

(51) Int. Cl.
*A63C 19/08* (2006.01)
*A63B 69/00* (2006.01)
*A63B 71/02* (2006.01)

(52) U.S. Cl.
CPC ..... *A63C 19/08* (2013.01); *A63B 69/0097* (2013.01); *A63B 71/023* (2013.01);
(Continued)

(58) Field of Classification Search
CPC ..... A63B 69/0097; A63B 69/00; A63B 63/00; A63B 61/02; A63B 71/0045;
(Continued)

(56) References Cited

U.S. PATENT DOCUMENTS 906,848 A 12/1908 Atwell
4,088,317 A 5/1978 Gierla
(Continued)

FOREIGN PATENT DOCUMENTS

CA 2755174 A1 4/2013
CA 2978013 A1 9/2016
(Continued)

OTHER PUBLICATIONS

International Search Report for International Patent Application No. PCT/GB2019/000049 dated Jun. 28, 2019, 3 pages.
(Continued)

*Primary Examiner* — Raleigh W Chiu
(74) *Attorney, Agent, or Firm* — Klintworth & Rozenblat IP LLP

(57) ABSTRACT

A sports ball rebound and boundary system including at least one portable post portion, configured to in use stand upright unsupported, and a barrier portion. The post portion and the barrier portion are configured for mutual releasable connection so that at least part of the barrier portion is extendible from the post portion to form a substantially vertically aligned planar barrier extending upwards from substantially ground level. The barrier portion is further configured to in use remain under sufficient tension to cause a ball or similar to rebound when striking the barrier.

20 Claims, 11 Drawing Sheets

(52) U.S. Cl.
CPC ... *A63B 2071/025* (2013.01); *A63B 2071/026* (2013.01); *A63B 2210/58* (2013.01); *A63C 2019/085* (2013.01); *A63C 2203/10* (2013.01)

(58) Field of Classification Search
CPC ..... A63B 2102/02; A63B 2210/50; A63B 2210/58; A63B 71/023; A63B 2071/025; A63B 2071/026; A63C 19/08; A63C 19/00; A63C 2019/085; A63C 2203/10
See application file for complete search history.

(56) References Cited

U.S. PATENT DOCUMENTS

| | | | | |
|---|---|---|---|---|
| 4,595,155 | A | 6/1986 | Gough | |
| 4,650,189 | A * | 3/1987 | Rajacich | A63B 69/0097 473/434 |
| 5,402,988 | A * | 4/1995 | Eisele | A63B 71/022 256/73 |
| 5,433,433 | A * | 7/1995 | Armell | A63B 63/004 273/400 |
| 6,142,701 | A | 11/2000 | Falcon | |
| 8,475,301 | B1 | 7/2013 | Lane | |
| 11,192,009 | B1 * | 12/2021 | Saphire | A63B 61/003 |
| 2002/0005512 | A1 | 1/2002 | Trill | |
| 2003/0056907 | A1 * | 3/2003 | Caveney | G09F 15/0068 160/135 |
| 2014/0179466 | A1 * | 6/2014 | Myers | A63B 67/002 473/476 |
| 2014/0332742 | A1 | 11/2014 | Gentles et al. | |
| 2017/0128807 | A1 * | 5/2017 | Bohan | A63B 71/0622 |
| 2021/0008440 | A1 * | 1/2021 | Anders | A63B 69/0097 |
| 2022/0193512 | A1 * | 6/2022 | Callender, Jr. | A63B 61/02 |
| 2022/0203191 | A1 * | 6/2022 | Saphire | A63B 61/003 |

FOREIGN PATENT DOCUMENTS

| | | | | |
|---|---|---|---|---|
| CN | 106730705 | A * | 5/2017 | A63B 61/00 |
| CN | 107158683 | A * | 9/2017 | A63B 69/0097 |
| GB | 2536890 | A | 10/2016 | |
| KR | 20110101432 | A | 9/2011 | |
| KR | 102269948 | B1 * | 6/2021 | A63B 61/00 |
| WO | 2017/150029 | A1 | 9/2017 | |
| WO | WO-2019180399 | A1 * | 9/2019 | A63B 69/0097 |

OTHER PUBLICATIONS

Machine translation of KR 20110101432.
Machine translation of WO 2017/150029.

* cited by examiner

SPORTS BALL REBOUND AND BOUNDARY SYSTEM

FIELD

The present invention relates to a sports ball rebound and boundary system. More particularly, the present invention relates to a modular portable sports ball rebound and boundary system. Even more particularly, the present invention relates to a modular portable sports ball rebound and boundary system having retractable boundary portions. Even more particularly, the present invention relates to a modular portable sports ball rebound and boundary system having retractable boundary portions which act in use as both boundary markers and ball rebounders.

BACKGROUND

Rebounder or ball-wall systems are commonly used in both professional and amateur or club training and games. Systems of this type are used to train and encourage passing and shooting accuracy, ball receiving and return training, volley shot training, etc. Rebounder/ball-wall systems of the known type are often small, heavy, or take time to set up and take down.

Population density and lack of resource in certain areas has lead to sports halls or playing fields being used for multiple sports, with multiple sets of floor markings used to indicate boundaries or similar. It is also not uncommon for a field or hall to be sub-divided, so that multiple games can be played simultaneously using a single space. However, some team sports or games such as soccer or floor hockey require a fenced or barrier boundary system that prevents the ball or puck from escaping the line boundaries that are typically used for such games. Although permanent fence boundary systems for ball games are known, these are not suitable if the area is also used for other activities such as athletic sports where a permanent fence boundary system would hamper such activities, or where the sport is seasonal and the fence boundary system needs to be demountable.

Consequently there exists a need for a modular temporary portable boundary marking system that can be demounted once play has ceased, or at the end of a sports season.

There are several known fence boundary system constructions.

Ball game netting systems that can be used to set up a boundary for a temporary pitch are known. These are generally formed from upright solid one-piece fence posts from which netting is extended and hung. In use the fence posts are driven into the ground, or connected to bases that allow them to stand upright, with the netting extending from the posts.

Akon skirting and bellows produce a retractable safety barrier that has a sheet barrier portion that can be pulled or extended from an upright cylindrical roller unit, the sheet portion spring-loaded so that in use the sheet portion is held in tension, and will return and roll into the cylindrical storage unit when tension is released and not in use. The upright cylindrical roller units are permanently fixed in position where required.

Tigrox produce a portable roller that can be used for crowd direction and routing and for displaying advertising. However, the barrier is not 'full height' as the barrier sheet itself only covers/blocks the upper half of the full height of the barrier Rapid Roll Inc. produce a lightweight retractable fencing system that is intended for use as a roadworks fence barrier, where the fence barrier portion is manually rolled and unrolled from the storage upright.

CA2755174 describes and shows a net system wound around a central pole. The pole has to be driven into the ground in order to remain upright.

U.S. Pat. No. 4,088,317 describes and shows a system where poles are supported on suction cups. The net is not kept taut in use.

U.S. Pat. No. 4,595,155 describes and shows a system where the post has to be bolted to the ground in order to be used.

U.S. Pat. No. 6,142,701 describes and shows a system that uses freestanding posts, with a loose net running between these.

U.S. Pat. No. 906,848 describes and shows a system where the uprights have to be driven into the ground in order to remain upright.

WO2017/150029 shows a system that uses low-level tape to mark out playing boundaries.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY

It is an object of the present invention to provide a sports ball rebound and boundary system which goes some way to overcoming the abovementioned disadvantages or which at least provides the public or industry with a useful choice.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

Accordingly, in a first aspect the present invention may broadly be said to consist in a sports, ball rebound and boundary system, comprising: at least one portable post portion, configured to in use stand upright unsupported, and; a barrier portion, the post portion and barrier portion configured for mutual releasable connection so that at least part of the barrier portion is extendible from the post portion to form a substantially vertically aligned planar barrier extending upwards from substantially ground level, the barrier portion further configured to in use remain under sufficient tension to cause a ball or similar to rebound when striking the barrier. This allows a barrier or a pitch to be quickly and easily created, which can be used for sports ball practice, including rebound shots.

In an embodiment, the barrier portion is at least partly formed from a flexible elongate planar fabric.

In an embodiment, the flexible planar fabric comprises netting.

In an embodiment, the boundary portion further comprises a storage means configured to retain the fabric within the casing when not in use.

In an embodiment, the storage means comprises a casing, a central inner post contained within the casing, and a spring system connecting with the central inner post, the casing and central inner post configured so that the inner post can rotate axially within the casing, the spring system configured to exert reactive rotational torque on the central inner post, an inner end of the planar fabric barrier connected to the central inner post so that the barrier unwinds from the central inner post when pulled from the casing, and winds back around the central inner post when not in use, the spring system maintaining tension on the planar fabric barrier in use.

In an embodiment, the sports ball rebound and boundary system further comprises an outer post connected to an outer end of the planar fabric barrier.

In an embodiment, the post portion comprises a framework configured to receive and hold in position at least one barrier portion.

In an embodiment, the framework further comprises slots configured to receive multiple barrier portions.

In an embodiment, the framework is configured to receive the barrier portions at substantially equally spaced intervals around the vertical axis of the framework.

In an embodiment, the sports ball rebound and boundary system further comprises a plurality of fold-out legs connected at a lower end of the framework and configured to fold between a storage position located flat against the framework and a use position where the legs extend along the ground to support and stabilise the framework in an upright position.

In an embodiment, at least one of the legs is configured to extend substantially in the same direction as the barrier when both are extended, the remaining legs aligned at substantially 90 degree intervals around the perimeter of the framework.

In an embodiment, the sports ball rebound and boundary system further comprises at least one wheel connected to a lower end of the framework and configured to allow the framework to be rolled on the at least one wheel when tilted to one side but to rest securely on one end when upright.

In an embodiment, the sports ball rebound and boundary system further comprises a flexible rod connected at one end to the at least one portable post portion, and a cord connectable between the free end of the flexible rod and the barrier at a point remote from the post portion, the cord and rod sized so that when the cord is connected the rod is flexed and in tension to exert a pulling force on the barrier.

In an embodiment, the portable post portion comprises a casing and a base, the base extending from the lower end of the portable post portion so as to support the portable post portion in an upright position when the barrier portion is extended.

In an embodiment, the base comprises a pair of feet that extend at an angle to each side of the barrier when the barrier is extended.

In an embodiment, the base further comprises a heel portion that extends from substantially the opposite side as that of the barrier, the heel portion configured to receive a weight in use.

In an embodiment, the heel portion is configured to receive a weight of substantially 5 Kg in use.

In an embodiment, the base has a weight of substantially 10 Kg.

In an embodiment, the base is substantially planar.

In an embodiment, the base has a length of substantially 375 mm, and a maximum width across the feet from outer edge to outer edge of substantially 462 mm.

In an embodiment, the sports ball rebound and boundary system further comprises at least one wheel connected to the base and configured to allow the framework to be rolled on the at least one wheel when tilted to one side.

In an embodiment, the sports ball rebound and boundary system further comprises a central inner post contained within the casing, and a spring system connecting with the central inner post, the casing and central inner post configured so that the inner post can rotate axially within the casing, the spring system configured to exert reactive rotational torque on the central inner post, an inner end of the planar fabric barrier connected to the central inner post so that the barrier unwinds from the central inner post when pulled from the casing, and winds back around the central inner post when not in use, the spring system maintaining tension on the planar fabric barrier in use.

With respect to the above description then, it is to be realised that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

Therefore, the foregoing, is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE FIGURES

Further aspects of the invention will become apparent from the following description which is given by way of example only and with reference to the accompanying drawings which show an embodiment of the device by way of example, and in which.

DETAILED DESCRIPTION

Embodiment of the inventions, and variations thereof, will now be described in detail with reference to the figures.

A first embodiment of the sports ball rebound and boundary system of the present invention is shown in FIGS. 1 to 5. The system 1 comprises two main parts: a net portion 2 and a post portion 3.

Net Portion

Figures 1A, 1B, 1C:
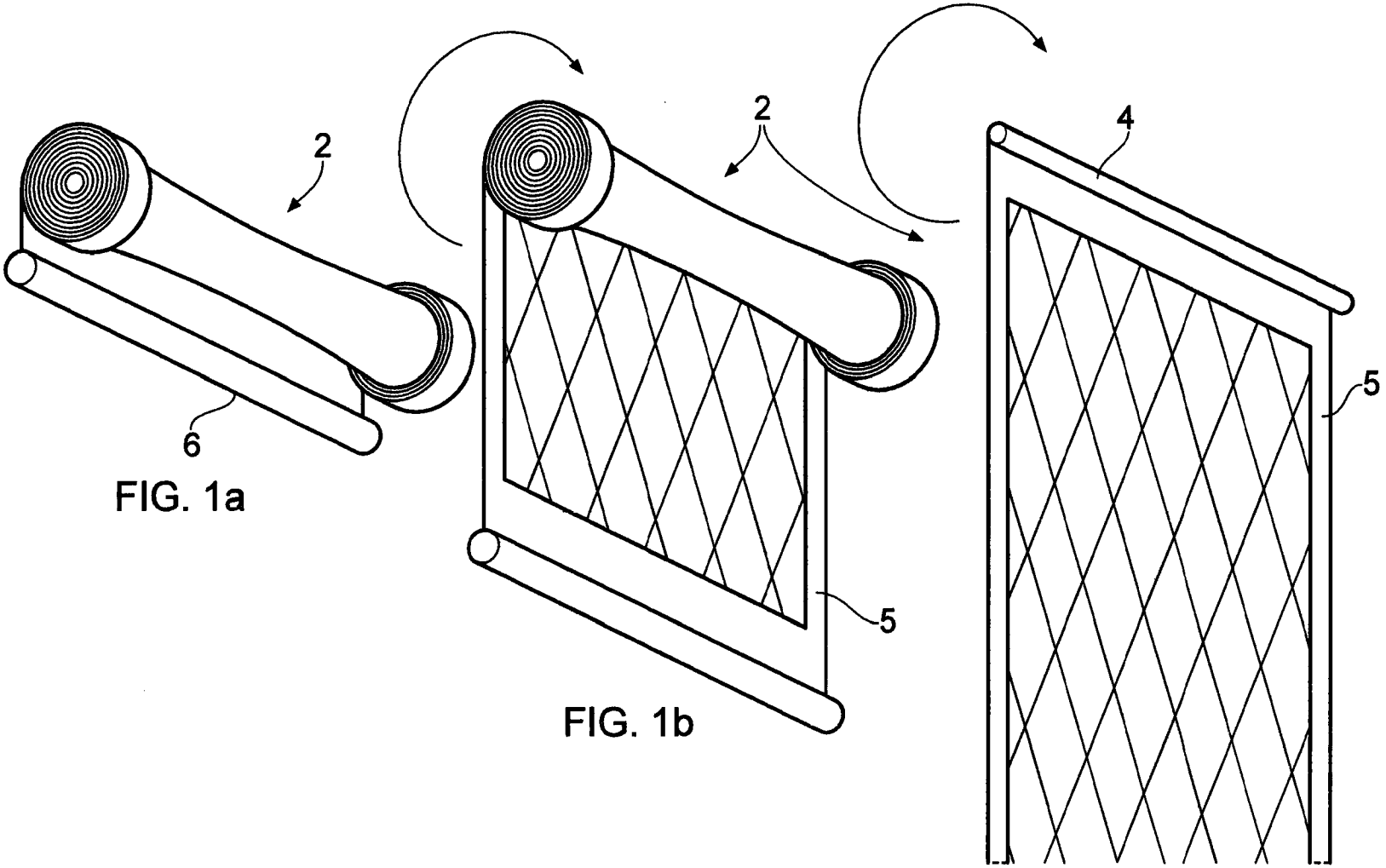
FIGS. 1*a*-1*c* show perspective views the inner part of a net portion that forms part of the sports ball rebound and boundary system of the present invention, the net portion having an inner and an outer rod, and a net that extends between the two rods, and which can be wound around the inner rod for storage, the net shown as fully wound, partially wound, and fully unwound in FIGS. 1*a* to 1*c* respectively.
Figure 2:
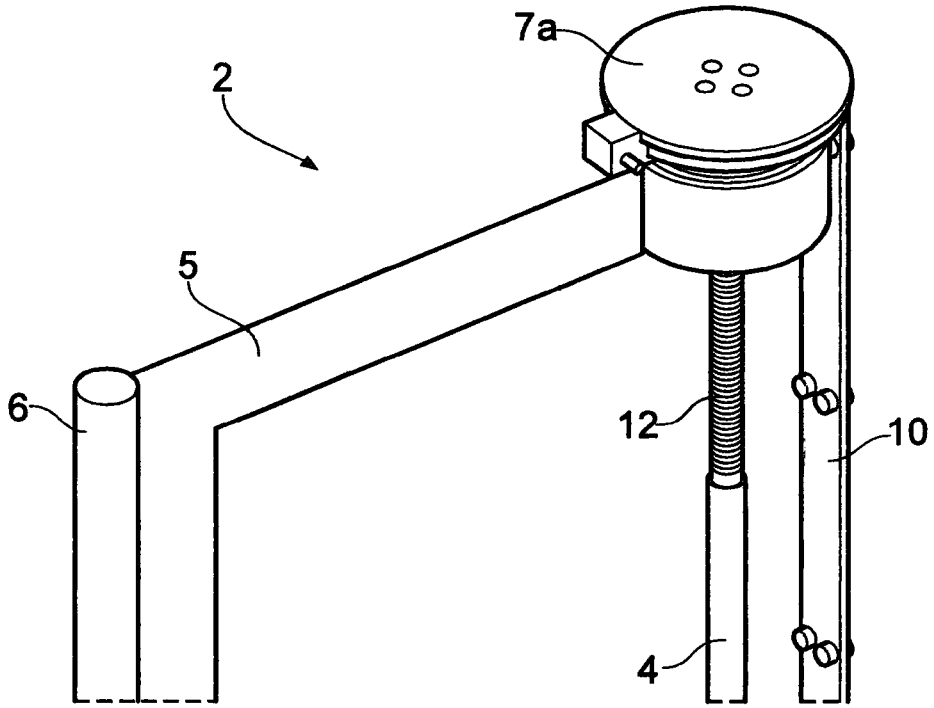
FIG. 2 shows a perspective detail view of one end of the net portion of FIG. 1, also showing an end cap and a spring.
Figure 3:
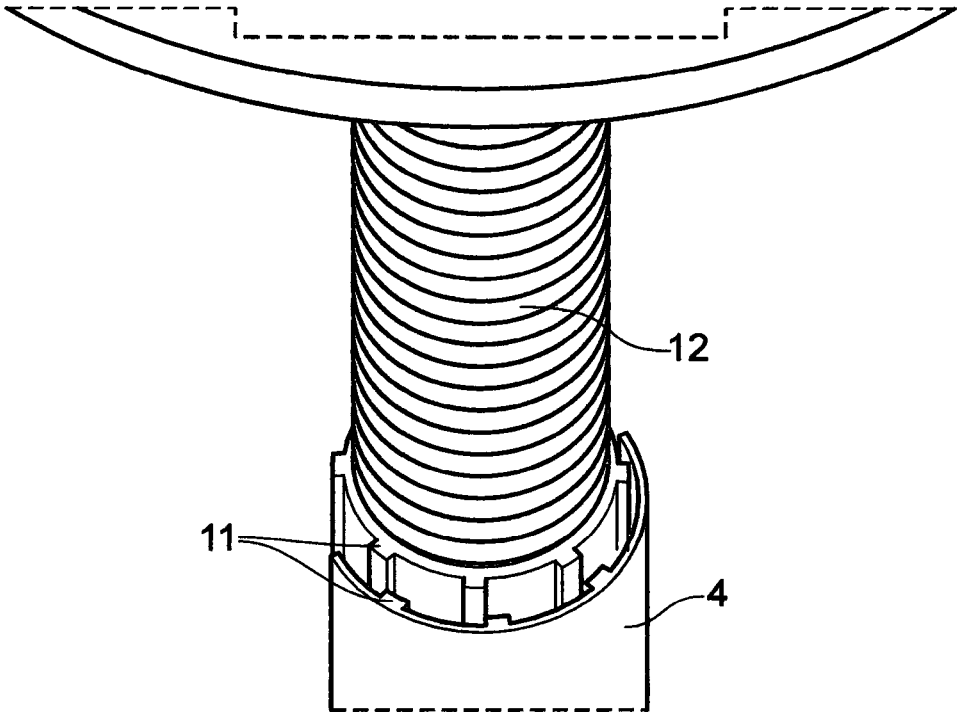
FIG. 3 shows detail of the spring and central rod of FIG. 2.
Figure 4A:
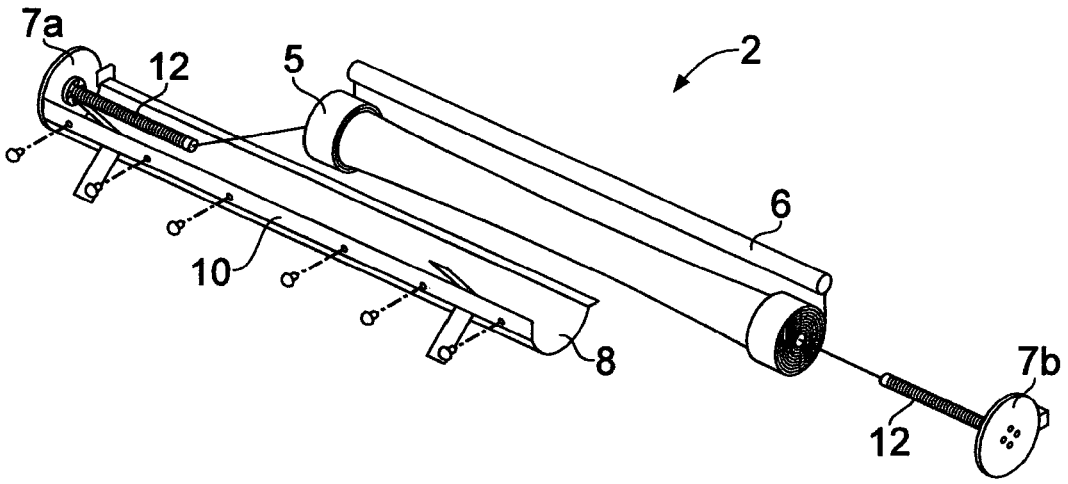
FIG. 4*a* shows an exploded perspective view of the net portion, showing detail of the end caps and a casing that encloses the fully wound net.
Figure 4B:
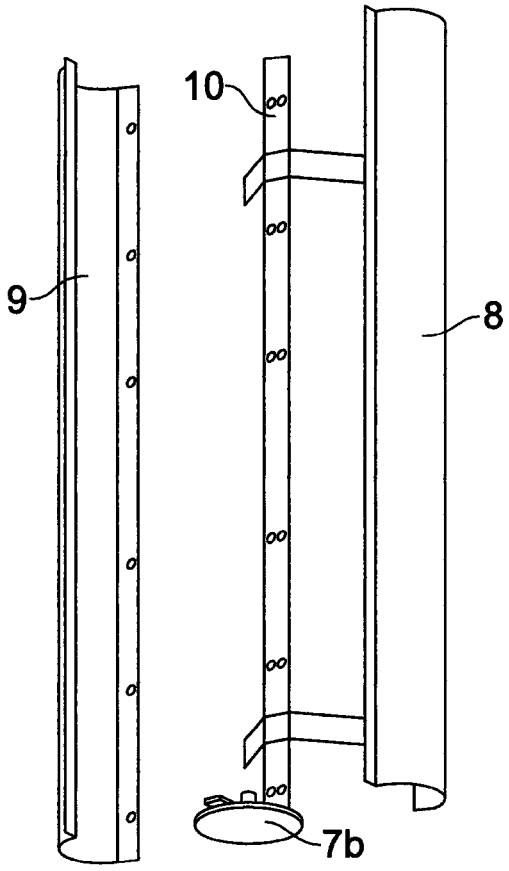
FIG. 4*b* shows a perspective exploded view of the casing.
Figure 5A:
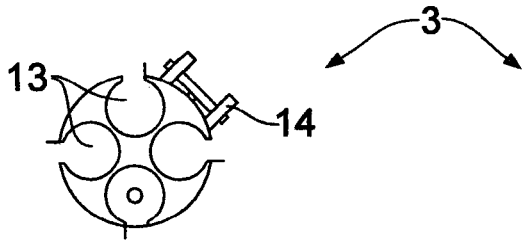
FIG. 5 shows views from the side and above of a post portion that forms part of the sports ball rebound and boundary system of the present invention, the post portion having a central section configured to receive the net portion in four slots, and legs that can be deployed to stabilise the post portion in use.
Figure 5B:
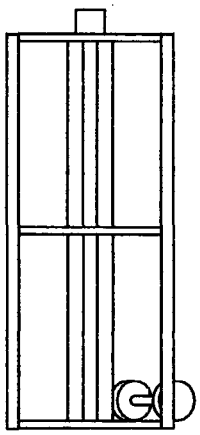
Figure 5C:
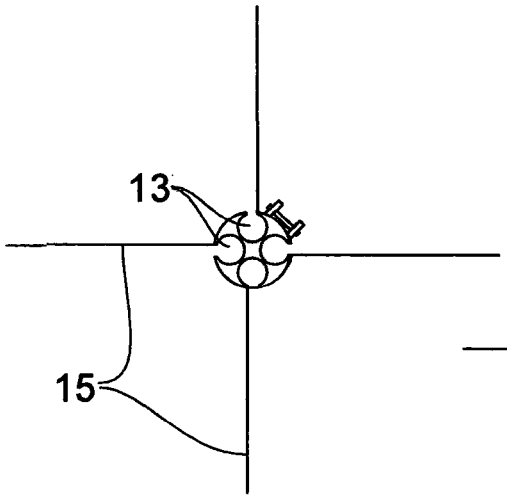
Figure 5D:
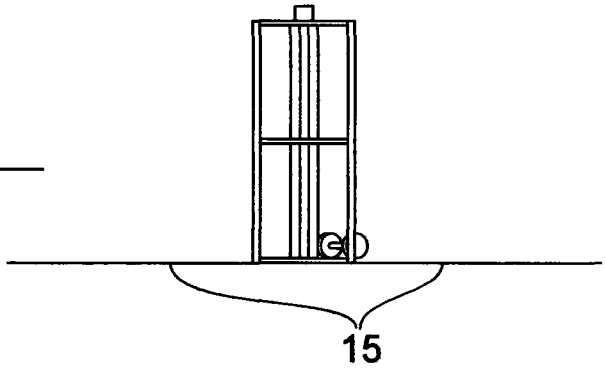

The net portion 2 comprises a central metal inner post 4, a net 5 and an outer post 6. One end of the net 5 is connected to the inner post 4, and the other end is connected to the outer post 6. The net 5 can be extended in a planar manner between the two posts 4, 6, or stored by winding the net 5 around the inner post 4, as shown in FIGS. 1*a* and 1*b*. As shown in FIG. 4*b*, the net 5 and posts 4, 6 are located in a casing formed from a main body 10 and two cover halves 8, 9. The case is generally cylindrical. The net 5 extends through a slot formed between two adjacent edges of the cover halves 8, 9. The net 5 can be formed from any suitable textile fabric or mesh net. A preferred form is 5 mm hexagonal net mask, with an overall length of 7.5 metres. This allows two fully extended nets to be used end-to-end or back-to-back to create an overall length of net between two posts of 15 metres. However the net 5 can be used in ten-metre or five-metre lengths as required. To facilitate connection of the two nets 5 back-to-back, a central pole can be used, with the outer posts 6 connecting to this, the central pole having a weighted base that rests on the ground to keep the nets 5 in position.

The net portion 2 further comprises a spring and storage system that keeps the net 5 in tension in use, by exerting a pulling force on the net when it is unwound, and biasing it back towards being wound up around the inner post 4. The outer post 6 prevents the net 5 from fully winding within the case 7 by butting against the edges of the cover halves 8, 9. Two end caps 7*a*, 7*b* are located at each end of the main body 10, connected to the main body 10 and the cover halves 8, 9. The central inner post 4 runs between the two end caps, the ends of the inner post 4 connected to the inner faces of the end caps at each end via coil springs 12 whose axes are coincident with that of the inner post 4, and which extend inwards from each of the end caps. The springs 12 engage with the inner post 4 via teeth 11, so that as the inner post rotates as the net is unwound, the coil springs are twisted into tension. In use, the springs attempt to return to a non-twisted state, which puts rotational force onto the inner post 4, causing the net to be in tension when unwound. This allows the fabric textile or mesh net fence to quickly and effectively roll in or out of the casing 7, which can be a critical factor when setting up and removing the system before and after use. This also offers a compact form for storing. The springs also hold the net sufficiently in tension to allow it to be used as a rebounder during play—balls striking the net will bounce off in the same manner as if they have struck a backboard or other rigid item, rather than the energy being absorbed by a non-tensioned net.

Post Portion

Figure 6A:
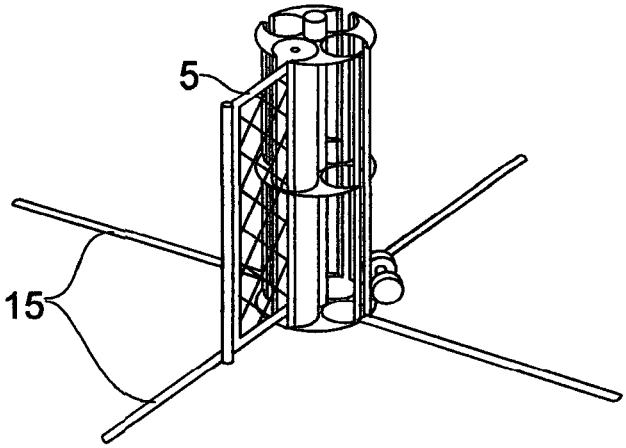
FIG. 6 shows perspective views of the post portion of FIG. 5, with the legs deployed and folded/undeployed, with a net portion shown slotted into the post portion and partially deployed.
Figure 6B:
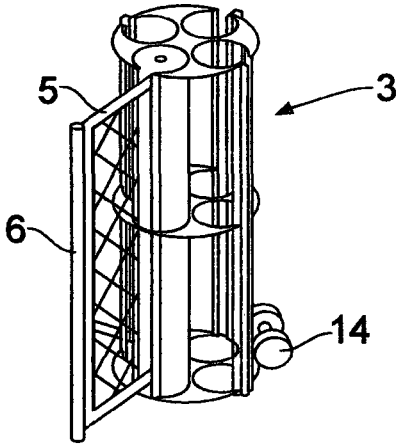

The post portion 3 is shown in detail in FIGS. 5 and 6. The post portion 3 has an overall generally cylindrical form, and is formed as a framework structure. As shown in FIG. 5*a*, the post portion is circular in plan view, and is formed so that four of the net portions 2 can be slotted into slots 13 that are evenly spaced around the post portion 3. The net portions 2 are held snugly within the slots 13 in the post portion 3, with the outer post resting against the outer perimeter or circumference of the post portion. The post portion 3 is substantially the same height as the net portion 2.

The post portion 3 has wheels 14 at the lower end, so that the post portion 3 can be tilted onto the wheels and rolled for transport.

Four legs 15 are located on the post portion 3, hingedly connected to the base or bottom of the post portion 3 so that they can be folded out to lie flat along a surface or the ground to act as stabilisers for the post portion 3. The legs 15 and slots 13 are aligned so that when the net 5 is extended, it will extend along the same line as the unfolded leg on that side of the post portion 3. The legs 15 are evenly spaced around the post portion 3, at 90 degrees from one another around the circumference. The legs are of sufficient length that the post portion can free stand, or stand unsupported (that is, without the need for an active ground engagement system such as a spike, bolts, screws or suckers), even with the net deployed and acting as a pulling force on the post portion, and even with the net receiving strikes from balls or similar that add to the pulling force.

Use

Figure 7:
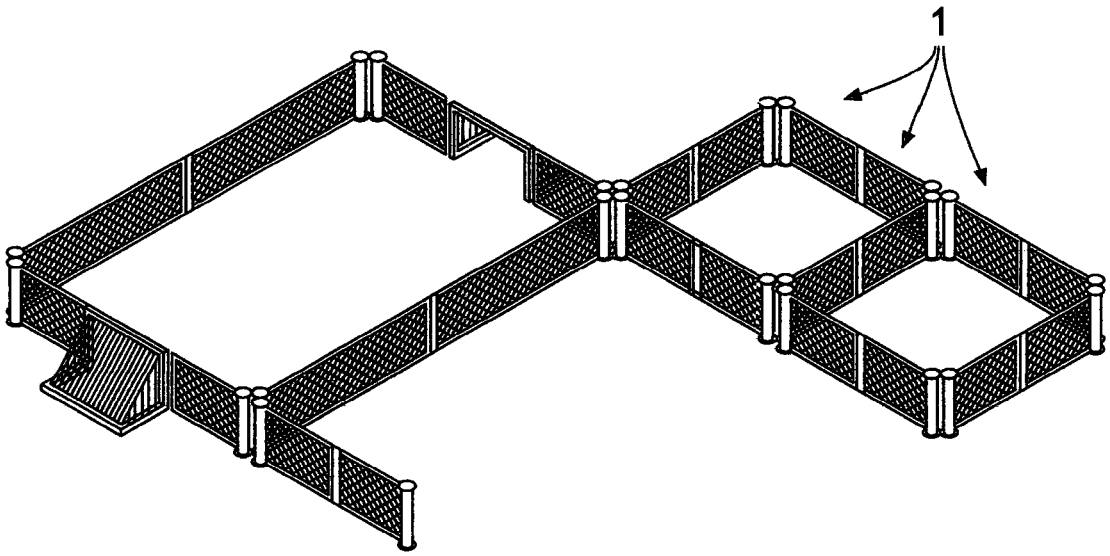
FIG. 7 shows a perspective number of the sports ball rebound and boundary system units in use to sub-divide an area into sports pitches.
Figure 8:
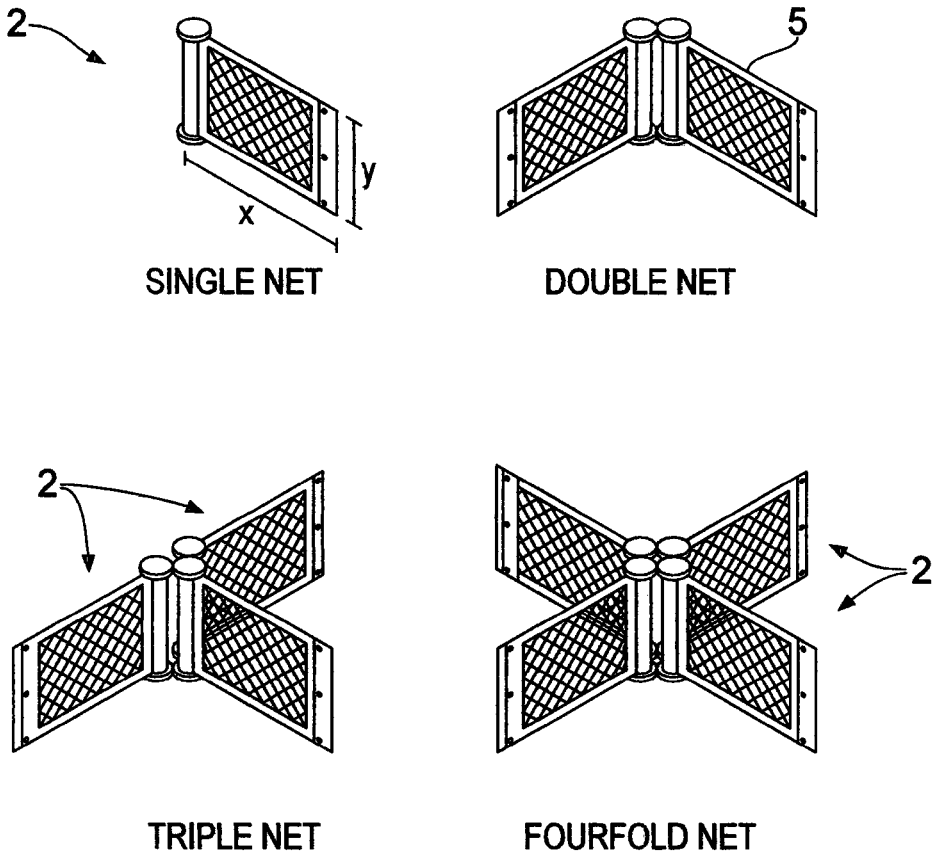
FIG. 8 shows a view of a number of the net portions located as they would be for use in the slots of the post portion, the post portion not shown.
Figure 9:
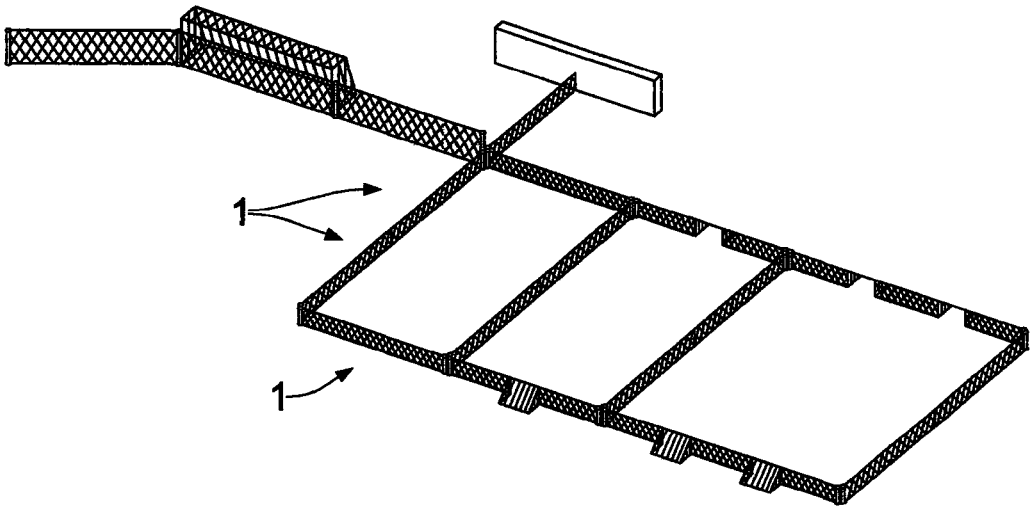
FIG. 9 shows a perspective number of the sports ball rebound and boundary system units in use to sub-divide an area into sports pitches.

The sports ball rebound and boundary system 1 is shown in use in FIGS. 7, 8 and 9, to mark out subsections of a greater area—that is, pitches or similar within a larger field or hall.

A user places the post portions 3 in the required locations—e.g. in the comers of a pitch or similar. They deploy the legs 15 to stabilise the post portions 15. The net portions 2 are slotted into the slots 13 as required. The net 5 is then extended from the net portion 2 via the outer post 6, and is connected to another post 6 from another net portion 2, or to another suitable location such as the edge of a goal or similar. This allows areas to be sectioned off to form pitches or similar with boundaries formed by the nets 5, which are held in tension by the springs 12.

This spring-loaded functionality creates a spring-tension effect in each of the net sections 5 that enables the barrier formed from the nets 5 to be used as a rebounder wall for ball sport, especially football/soccer play. This is in combination with the boundary nature of the net 5 in use.

The system 1 allows the creation of training environments that allow rebound/ball-wall exercises on outdoor fields. A primary use will be for ball sport, mainly football/soccer training exercises and games like passing practice, target practice, one-on-one games, multiplayer games. The spring-tension function will also allow the net 5 barrier sections to be used as a ball-wall for passing and trick-shots during play or training, imitating the similar function of a hardboard boundary, or a permanent wall boundary. This creates advantages for game play and training exercises. Secondary uses will be as a ball boundary system to hinder the ball shot or passed to escape and thereby towering the training or game intensity and effect. The system is modular, and in use a number of individual, identical pieces are used together, for example to form the boundary lines of a sports pitch as described above.

Figure 10:
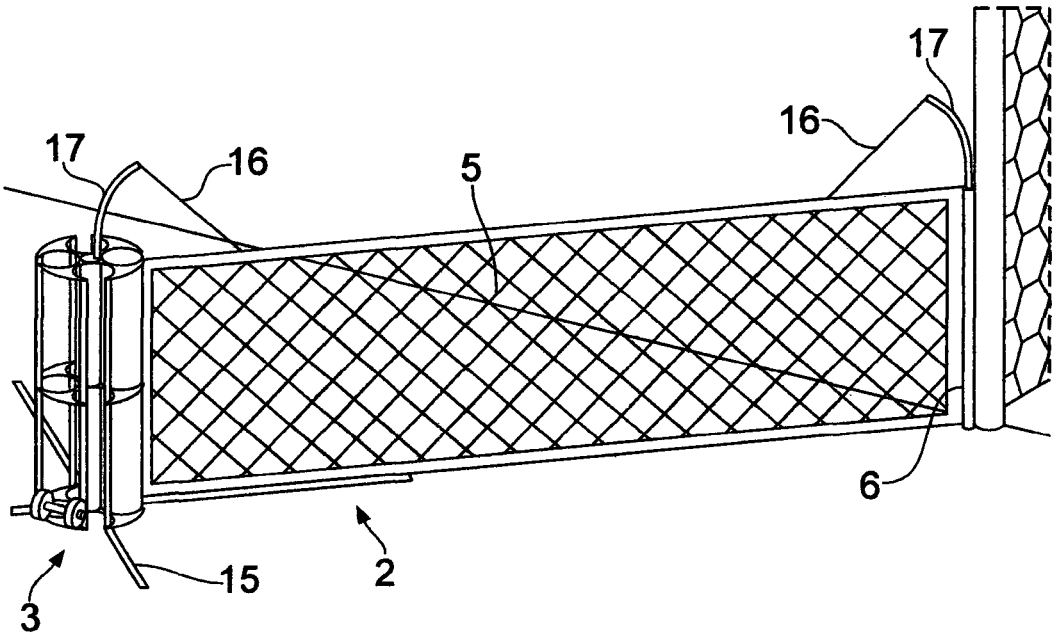
FIG. 10 shows the system of FIGS. 1 to 9 in use, with a net tensioning system used to help keep the net in tension.
Figure 11:
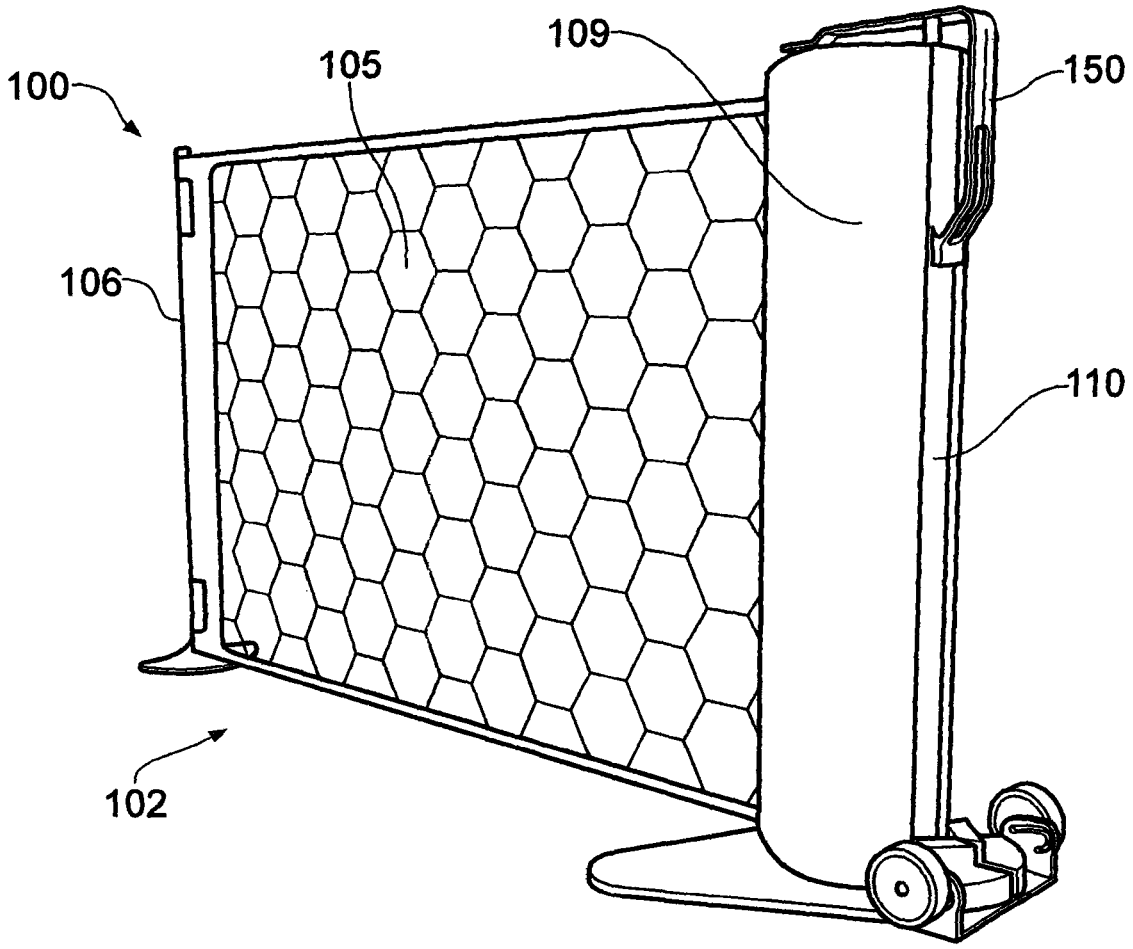
FIG. 11 shows a perspective view from one end and to the side of another embodiment of integrated post and barrier that can be used to form part of a sports ball rebound and boundary system, with the barrier part extended.

A variation on the system described above is shown in FIG. 10. In this variation, a flexible fibreglass rod 17 extends from the centre-top of the post portion 3. This connects with one end of a cord, rope, strap or similar item. The other end of the rope 16 detachably connects with the top edge of the net 5 at a point some distance away from the post portion 3. However, the rope 16, the rod 17 and the connection point for the rope 16 on the net 5 are all sized and located so that the rod 17 will need to bend and be in bending tension to connect the rope 16 to the net 5. This assist with keeping the net 5 in tension, by adding additional tension to that generated by the springs 12.

Second Embodiment—Integrated Net and Post Portion

A second form of the system—system element 100—is shown in FIGS. 11 to 17.

In this embodiment, the net portion or upright portion 102 comprises a central metal inner post or spine 104, a net 105 and an outer post 106, surrounded by a casing (described below). One end of the net 105 is connected to the inner post 104, and the other end is connected to the outer post 106. The net 105 is extended in use in a planar manner in use between the two posts 104, 106.

Figure 12:
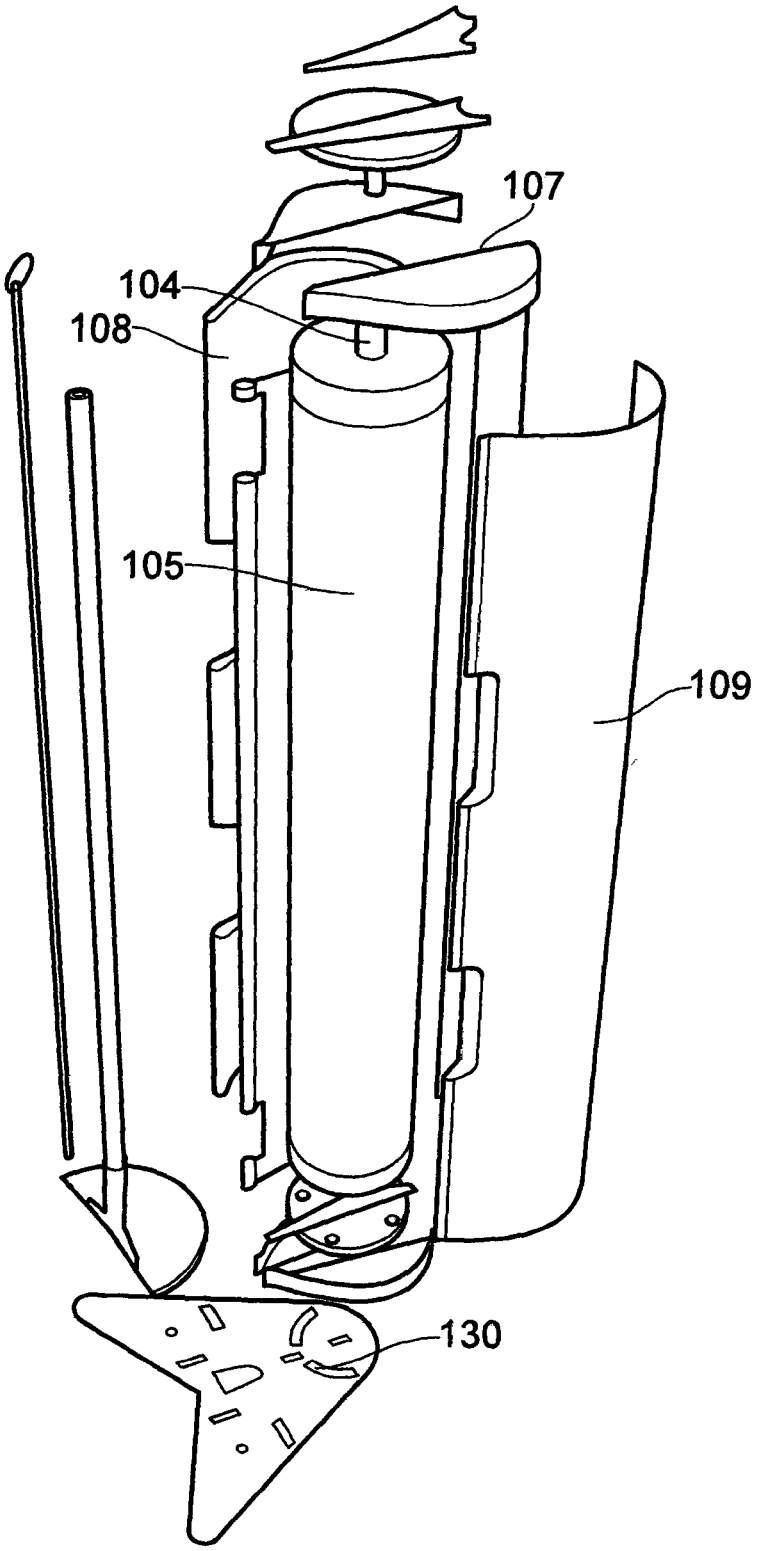
FIG. 12 shows an exploded perspective view of the integrated post and barrier system of FIG. 11.
Figure 13:
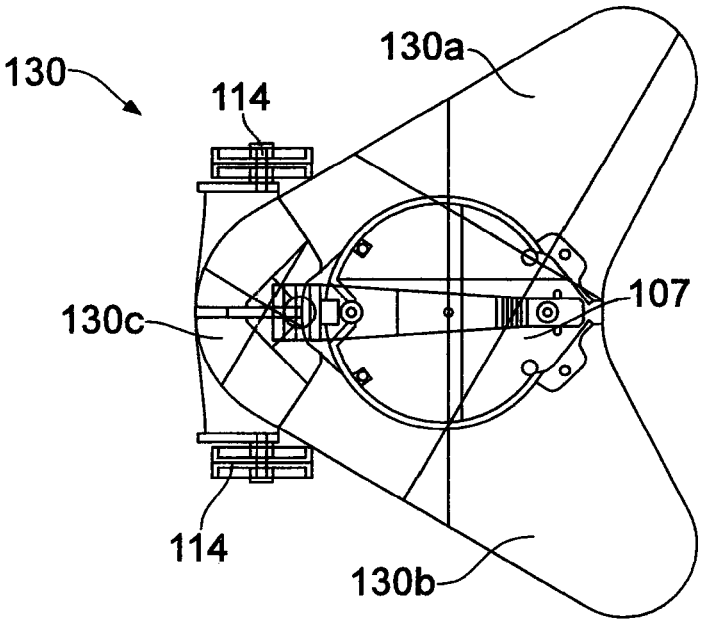
FIG. 13 shows a top view of the integrated post and barrier system of FIGS. 11 and 12.
Figure 14:
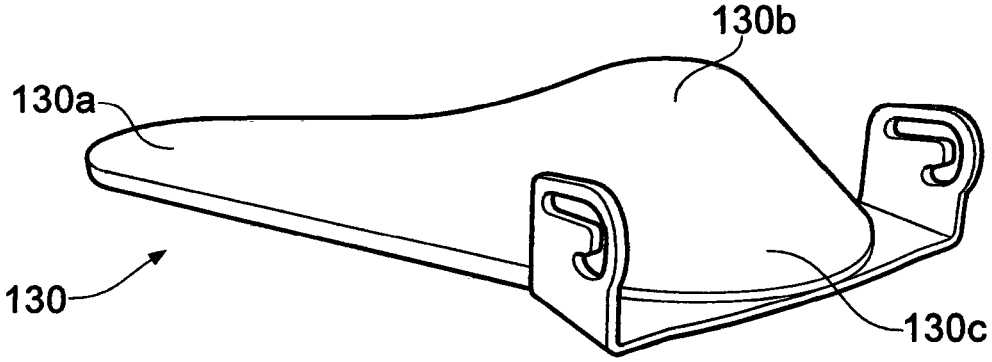
FIG. 14 shows a perspective view of a foot part of the integrated post and barrier of FIGS. 11 to 13.
Figure 15:
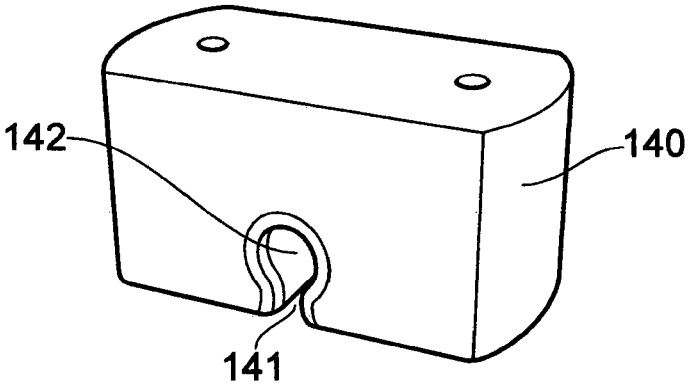
FIG. 15 shows a perspective view of a net guide block, integrated with the post to assist with keeping the barrier in the correct position.
Figure 16:
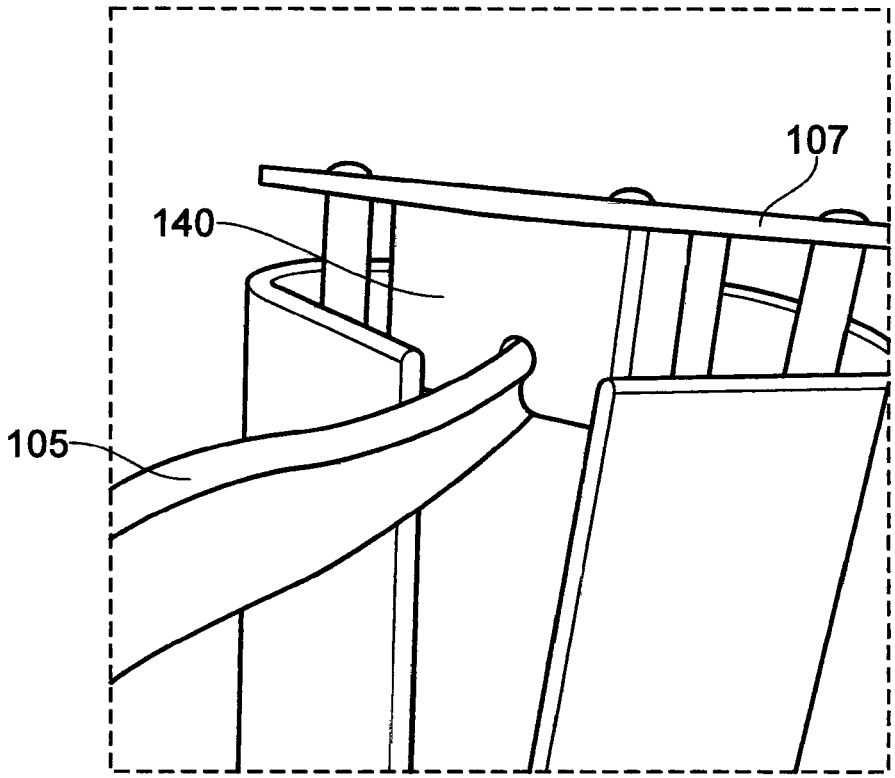
FIG. 16 shows a semi-exploded view of the top of the post with the guide block in place and the upper edge of the net running through this.

As shown in FIG. 12, the net 105 in this embodiment is located in a casing formed from a main body or spine 110 and two cover halves 108, 109. The spine 110 is formed from extruded aluminium, and the two cover halves are formed from UPVC. The casing is generally teardrop-shaped when viewed from above or from one end. The net 105 extends through a slot formed between two adjacent edges of the cover halves 108, 109, at the 'point' of the teardrop. The net 105 can be formed from any suitable textile fabric or mesh net. A preferred form is 5 mm hexagonal net mask, with an overall length of 7.5 metres. This allows two systems 100 with fully extended nets to be used end-to-end or back-to-back to create an overall length of net between the two upright portions 102 of 15 metres. However the net 105 can be used in ten-metre or five-metre lengths as required. To facilitate connection of the two nets 105 back-to-back, a central connector pole can be used, with the outer posts 106 connecting to this on opposite sides, the central pole having a weighted base that rests on the ground to keep the nets 105 in position.

The net 105 is retained or biased towards being wound up inside the casing by a similar spring system to that of the first embodiment. This also keeps the net 105 in tension in use by exerting a pulling force on the net when it is unwound, and biasing it back towards being wound up around the inner post 104. The outer post 106 prevents the net 105 from fully winding within the casing formed from the main body 110 and two cover halves 108, 109 by butting against the edges of the cover halves. An upper end cap 107 is located at the top end of the main body 110, closing off the top of the casing.

In this embodiment, the top edge of the net has a rope or wire or similarly-profiled flexible extension built in, by locating this inside a cloth flap that folds over and extends along the top of the net 105. A guide block 140 is located in the casing, just underneath the end cap 107. The guide block 140 has a groove 141 in the lower side that extends upwards into the block to a guide aperture 142 that is sized and shaped to receive the rope or wire in the top of the net, the body of the net extending down through the groove 141. This assists with keeping the net 105 correctly aligned when this is extended or retracted.

A base 130 is located at the bottom of the casing. The base 130 is formed from metal sheet, and has a net-side portion 130*a*, 130*b* that extends from the base in the same direction as the net extends in use, and a heel or rear-side portion 130*c* that extends from the other or opposite side. The base 130 is planar, and is aligned so that it will rest flat against a surface when the system element 100 is deployed. The net-side portion of the base 130 comprises two lobes or feet 130*a*, 130*b* that extend out at roughly a 45-degree angle to each side of the net 105 in use. In this embodiment, the base 130 has a weight of 10 Kg. The base has a length of substantially 375 mm, and a maximum width across the feet from outer edge to outer edge of substantially 462 mm.

An additional weighted element can be located on the heel, this additional element weighing 5 Kg in the preferred embodiment, and shaped so that this has a profile that allows it to butt up against the rear of the upright. This additional weight can be added or removed as required, and replaced with heavier or lighter elements as required. The spread and extension of the feet 130*a*, 130*b* in combination with the heel 130*c*, and if additionally required, the weighted element on the heel, allows the system element 100 to remain upright unsupported (that is, without needing physical attachment to a surface such as would be provided by a ground spike, pegs, suction cups, bolts or screws), and to remain upright even with the net extended and in tension, and also when additional forces are exerted on the system by ball strikes to the net or similar.

In the preferred embodiment, the base has a length of substantially 375 mm from the tips of the toe to the rear of the heel, and a maximum width at or across the inner end of the feet of substantially 462 mm.

Two wheels 114 are connected to the heel 130*c* on each side. In use, these can be folded up above the base 130, and then folded downward and rearwards so that the combined net/post portion 102/103 can be tilted onto the wheels and rolled for transport.

Figure 17:
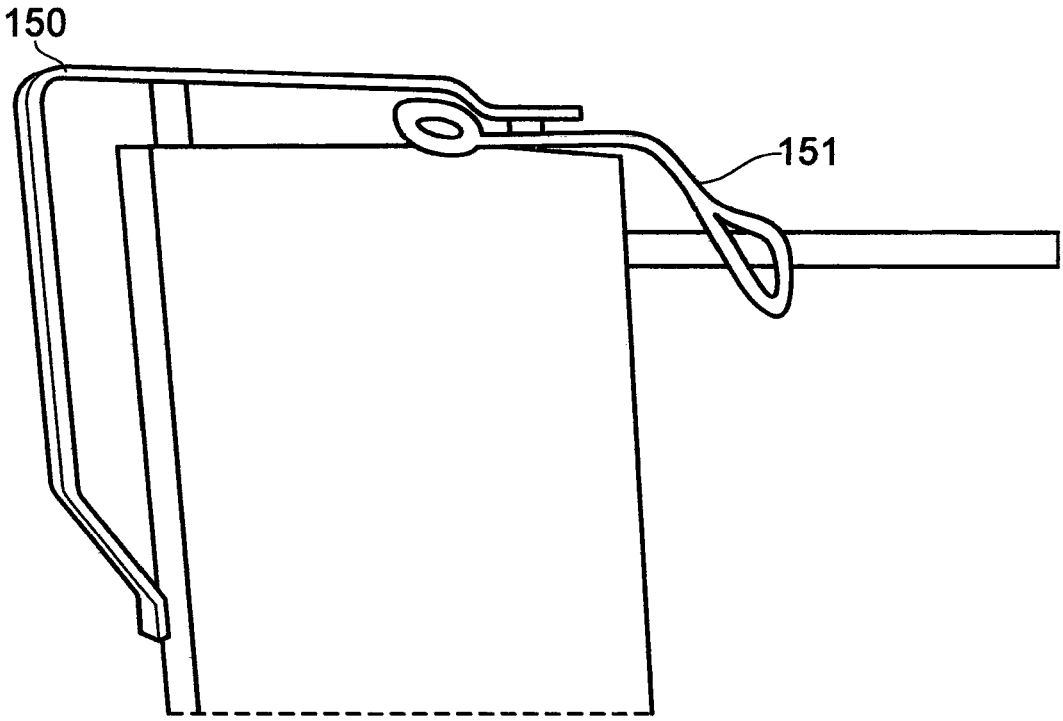
FIG. 17 shows a side perspective view of the top of the post portion of FIG. 11, with a handle shown connected to the top of the post portion.
Figure 18:
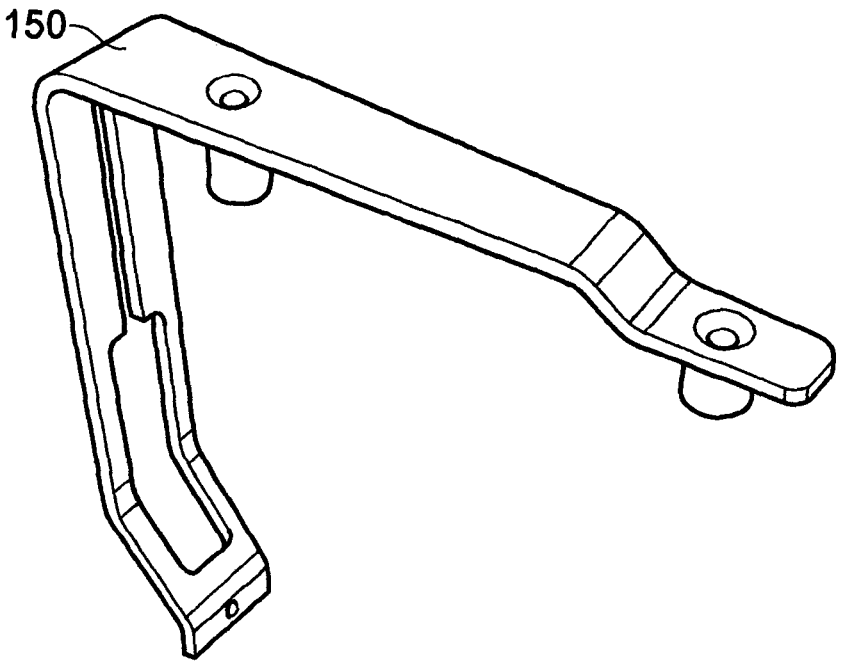
FIG. 18 shows a perspective view from the side and above of the handle of FIG. 16.

A handle 150 is located at the top of the casing. In the preferred embodiment, a tightening unit 151 formed from rubber or silicone rubber or a similar elasticated material is connected between the handle and the top of the net as shown in FIG. 17, to assist with increasing the tension of the net when fully stretched. This enables a net of a set length to only be partially extended and still keep the tension to a level of where balls will rebound. This is important as the net will usually have much more tension when extended to full length, so the unit 151 assists with keeping the net in tension. The loop elastic stops the retract coil spring from pulling.

In use, two system elements 100 elements can be placed spaced apart with their fronts or feet 130*a*, 130*b* facing towards each other. The nets 105 of each of the system elements 100 can be extended and connected at their outer ends. Alternatively these can be placed back to back, with the nets extending away from one another.

Figure 19:
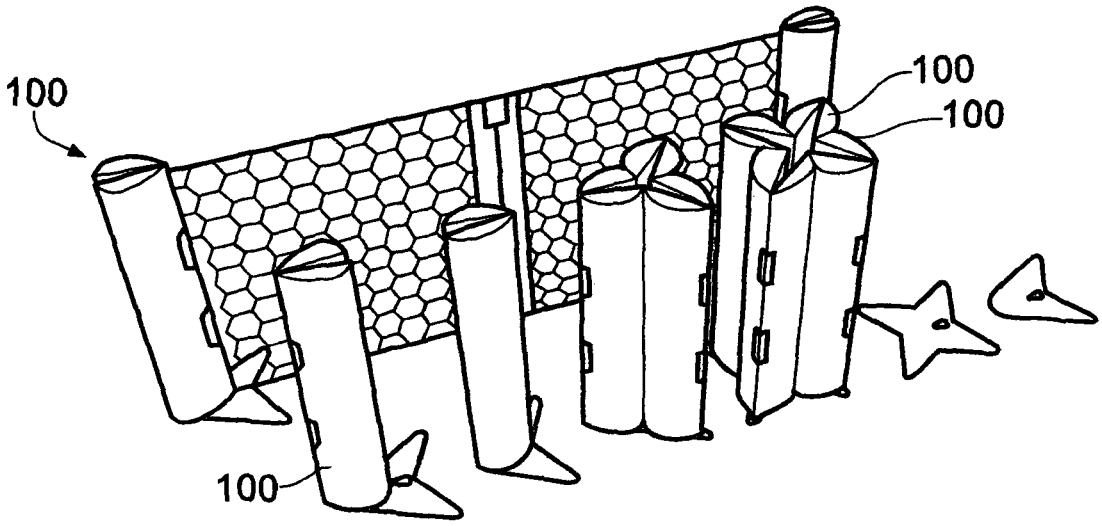
FIG. 19 shows arrangements of the integrated post and barrier system, with these clustered or grouped in configurations of three and four units.

Alternatively, as shown in FIG. 19, these can be placed in a 'four leaf' configuration, with four units grouped together, so that this allows the nets 105 to be extended outwards at 90-degrees or right angles to one another.

The invention claimed is:

1. A sports ball rebound and boundary system, comprising:

at least one portable post portion configured to stand upright unsupported when in a use position;

a barrier portion at least partly formed from a flexible elongate fabric, the at least one portable post portion and barrier portion configured so that in at least part of the barrier portion is extendible from the at least one portable post portion to form a substantially vertically aligned planar surface extending upwards from substantially ground level when in a use position, the barrier portion further configured to remain under sufficient tension to cause a ball or similar to rebound when striking the surface when in the use position;

the at least one portable post portion comprising a framework having slots, each slot configured to receive and hold a corresponding barrier portion in position;

a casing configured to hold the at least one portable post portion and the barrier portion; and storage means within the casing and which is configured to retain the barrier portion within the casing when in a storage position.

2. The sports ball rebound and boundary system as claimed in claim 1 wherein the flexible fabric comprises netting.

3. The sports ball rebound and boundary system as claimed in claim 1 wherein the at least one portable post portion includes a central inner post positioned within the casing, and wherein the storage means comprises a spring system connected with the casing and the central inner post, wherein the central inner post rotates axially within the casing and the spring system exerts reactive rotational torque on the central inner post, wherein an inner end of the barrier portion is connected to the central inner post so that the barrier portion unwinds from the central inner post when pulled from the casing into the use position and winds back around the central inner post when not in use and moved into the storage position, the spring system maintaining tension on the barrier portion when in the use position.

4. The sports ball rebound and boundary system as claimed in claim 3 wherein the at least one portable post portion further includes an outer post connected to an outer end of the barrier portion.

5. The sports ball rebound and boundary system as claimed in claim 1 wherein the framework is configured to receive the barrier portion and to receive additional barrier portions at substantially equally spaced intervals around a vertical axis of the framework.

6. The sports ball rebound and boundary system as claimed in claim 1 further comprising a plurality of fold-out legs connected at a lower end of the framework and configured to fold between a first position located flat against the framework and a second position where the plurality of fold-out legs extend along the ground to support and stabilize the framework in an upright position.

7. The sports ball rebound and boundary system as claimed in claim 6 wherein at least one of the legs is configured to extend substantially in the same direction as the barrier portion when both are extended, and the remaining legs are aligned at substantially 90 degree intervals around a perimeter of the framework.

8. The sports ball rebound and boundary system as claimed in claim 1 further comprising at least one wheel connected to a lower end of the framework and configured to allow the framework to be rolled on the at least one wheel when tilted to one side but to rest securely on one end of the framework when upright.

9. The sports ball rebound and boundary system as claimed in claim 1 further comprising a flexible rod connected at one end to the at least one portable post portion, and a cord connectable between a free end of the flexible rod and the barrier portion at a point remote from the at least one portable post portion, the cord and rod being sized so that the rod is flexed and in tension to exert a pulling force on the barrier portion when the cord is connected to the free end of the flexible rod and to the barrier portion.

10. A sports ball rebound and boundary system, comprising:

at least one portable post portion configured to stand upright unsupported when in a use position;

a barrier portion, the at least one portable post portion and barrier portion configured so that in at least part of the barrier portion is extendible from the at least one portable post portion to form a substantially vertically aligned planar surface extending upwards from substantially ground level when in a use position, the barrier portion further configured to remain under sufficient tension to cause a ball or similar to rebound when striking the surface when in the use position;

the at least one portable post portion comprising a framework having slots, each slot configured to receive and hold a corresponding barrier portion in position;

a casing configured to hold the at least one portable post portion and the barrier portion; and a base extending from a lower end of the at least one portable post portion so as to support the at least one portable post portion in an upright position when the barrier portion is extended.

11. The sports ball rebound and boundary system as claimed in claim 10 wherein the base comprises a pair of feet that extend at an angle to each side of the barrier portion when the barrier portion is extended.

12. The sports ball rebound and boundary system as claimed in claim 11 wherein the base has a length of substantially 375 mm, and a maximum width across the pair of feet from outer edge to outer edge of substantially 462 mm.

13. The sports ball rebound and boundary system as claimed in claim 10 wherein the base further comprises a heel portion that extends from substantially an opposite side as that of the barrier portion, the heel portion configured to receive a weight.

14. The sports ball rebound and boundary system as claimed in claim 13 wherein the heel portion is configured to receive a weight of substantially 5 Kg.

15. The sports ball rebound and boundary system as claimed in claim 10 wherein the base has a weight of substantially 10 Kg.

16. The sports ball rebound and boundary system as claimed in claim 10 wherein the base is substantially planar.

17. The sports ball rebound and boundary system as claimed in claim 10 further comprising at least one wheel connected to the base and configured to allow the framework to be rolled on the at least one wheel when tilted to one side.

18. The sports ball rebound and boundary system as claimed in claim 10 wherein the at least one portable post portion includes a central inner post positioned within the casing, and further comprising a spring system connected with the casing and the central inner post, wherein the central inner post rotates axially within the casing and the spring system exerts reactive rotational torque on the central inner post, wherein an inner end of the barrier portion is connected to the central inner post so that the barrier portion unwinds from the central inner post when pulled from the casing into the use position and winds back around the central inner post when not in use, the spring system maintaining tension on the barrier portion when in the use position.

19. The sports ball rebound and boundary system as claimed in claim 10 wherein the at least one portable post portion further includes an outer post connected to an outer end of the barrier portion.

20. A sports ball rebound and boundary system, comprising:

at least one portable post portion configured to stand upright unsupported when in a use position;

a barrier portion, the at least one portable post portion and barrier portion configured so that in at least part of the barrier portion is extendible from the at least one portable post portion to form a substantially vertically aligned planar surface extending upwards from substantially ground level when in a use position, the barrier portion further configured to remain under sufficient tension to cause a ball or similar to rebound when striking the surface when in the use position;

the at least one portable post portion comprising a framework having slots, each slot configured to receive and hold a corresponding barrier portion in position; and a flexible rod connected at one end to the at least one portable post portion, and a cord connectable between a free end of the flexible rod and the barrier portion at a point remote from the at least one portable post portion, the cord and rod being sized so that the rod is flexed and in tension to exert a pulling force on the barrier portion when the cord is connected to the free end of the flexible rod and to the barrier portion.

* * * * *